US008197390B2

(12) United States Patent
Ikegami

(10) Patent No.: US 8,197,390 B2
(45) Date of Patent: Jun. 12, 2012

(54) MINI-TRAMPOLINE WITH SUPPORT BAR

(75) Inventor: Masato Ikegami, Tokyo (JP)

(73) Assignee: Funtek USA, Inc., San Diego, CA (US)

( * ) Notice: Subject to any disclaimer, the term of this patent is extended or adjusted under 35 U.S.C. 154(b) by 1072 days.

(21) Appl. No.: 12/116,149

(22) Filed: May 6, 2008

(65) Prior Publication Data

US 2009/0280961 A1 Nov. 12, 2009

(51) Int. Cl.
*A63B 5/11* (2006.01)

(52) U.S. Cl. ..... 482/29; 482/39

(58) Field of Classification Search ..... 482/23, 482/24, 26–29, 38, 39, 43, 51, 74, 77, 78; 5/414, 505.1, 512, 662; 182/137–140; D21/668, D21/672, 797
See application file for complete search history.

(56) References Cited

U.S. PATENT DOCUMENTS

| | | | | |
|---|---|---|---|---|
| 810,615 | A | 1/1906 | Butler | |
| 2,799,867 | A | 7/1957 | Fenner et al. | |
| 3,031,688 | A | 5/1962 | Southwood | |
| 3,195,890 | A * | 7/1965 | Salls | 482/128 |
| 3,201,123 | A | 8/1965 | Nissen | |
| 3,339,925 | A * | 9/1967 | Nissen | 473/469 |
| 3,501,141 | A | 3/1970 | Nissen | |
| 3,580,570 | A | 5/1971 | Fenner et al. | |
| 3,767,192 | A | 10/1973 | Eriksson | |
| 3,983,585 | A | 10/1976 | Sidlinger | |
| 4,284,271 | A | 8/1981 | Petit et al. | |

(Continued)

FOREIGN PATENT DOCUMENTS

CA 2223301 A1 * 6/1999

(Continued)

OTHER PUBLICATIONS

European Search Report for European Patent Application No. 09159036.4 (related to the present application), publication date Jul. 31, 2009, Funtek USA, Inc.

*Primary Examiner* — Loan Thanh
*Assistant Examiner* — Victor K Hwang
(74) *Attorney, Agent, or Firm* — Roeder & Broder LLP

(57) ABSTRACT

A trampoline assembly (10) includes a bed (12), a base frame (14), a plurality of first resilient members (16) that connect the bed (12) to the base frame (14), and a support assembly (22). The support assembly (22) includes (i) a plurality of support arches (26) connected to the base frame (14) and cantilevering upward away from the base frame (14); (ii) a first support segment (28) that is connected to the base frame (14) and one of the support arches (26); (iii) a second support segment (30) that is connected to the base frame (14) and one of the support arches (26); (iv) a support bar (32); and (v) a plurality of support resilient members (34) that connect the support bar (32) to at least one of the plurality of support arches (26). In some embodiments, the plurality of support arches (26) extend around only a portion of the base frame (14). Further, each support arch (26) can be connected to at least one of the other support arches (26). Additionally, in some embodiments, the support bar (32) has a first end (48) and a spaced apart second end (50). For example, in some embodiments the support bar (32) is substantially C-shaped.

20 Claims, 3 Drawing Sheets

U.S. PATENT DOCUMENTS

| | | | | | |
|---|---|---|---|---|---|
| 4,478,420 | A | * | 10/1984 | Sowards | 473/435 |
| 4,598,905 | A | | 7/1986 | Vrana | |
| 4,836,530 | A | * | 6/1989 | Stanley, Jr. | 482/27 |
| D304,850 | S | * | 11/1989 | Chambers | D21/797 |
| 4,938,473 | A | * | 7/1990 | Lee et al. | 482/54 |
| 5,176,597 | A | * | 1/1993 | Bryne | 482/74 |
| 5,711,743 | A | | 1/1998 | Nichols, Jr. et al. | |
| 5,941,798 | A | | 8/1999 | Coan et al. | |
| 6,053,845 | A | | 4/2000 | Publicover et al. | |
| 6,135,922 | A | | 10/2000 | Nissen | |
| 7,331,903 | B2 | | 2/2008 | Nissen | |
| 7,850,575 | B1 | * | 12/2010 | Hsiang | 482/27 |
| 2006/0079378 | A1 | | 4/2006 | Ader | |
| 2007/0004560 | A1 | * | 1/2007 | Nelson | 482/29 |
| 2008/0076638 | A1 | * | 3/2008 | Publicover | 482/27 |
| 2008/0132384 | A1 | * | 6/2008 | Publicover | 482/27 |
| 2010/0285926 | A1 | * | 11/2010 | Ikegami | 482/27 |
| 2011/0160021 | A1 | * | 6/2011 | Publicover | 482/27 |
| 2011/0207582 | A1 | * | 8/2011 | Ikegami | 482/27 |

FOREIGN PATENT DOCUMENTS

| | | | | |
|---|---|---|---|---|
| CN | 2899854 | Y | * | 5/2007 |
| KR | 2006043077 | A | * | 5/2006 |
| WO | WO 9108026 | A1 | * | 6/1991 |

* cited by examiner

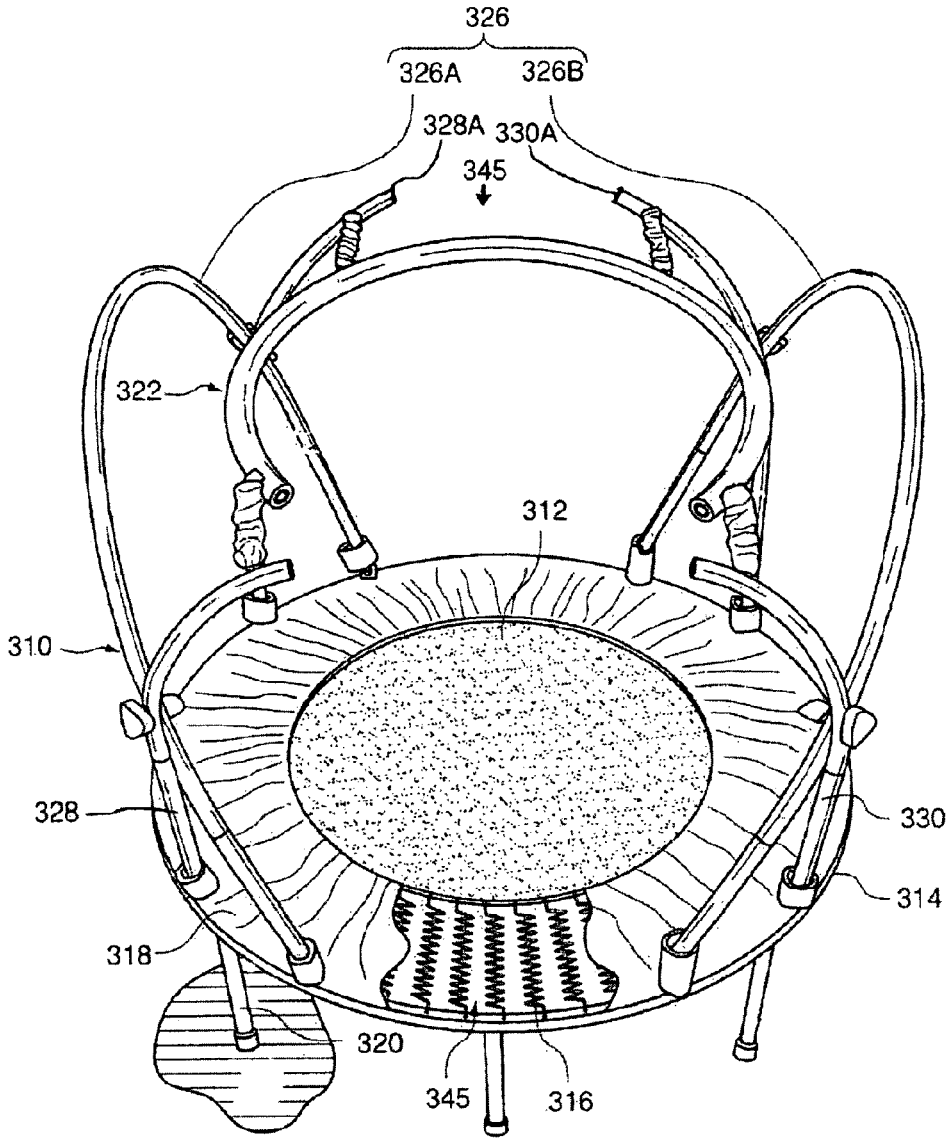
*FIG.* 3

MINI-TRAMPOLINE WITH SUPPORT BAR

BACKGROUND

For many, many years bouncing on a trampoline has been viewed as a fun and entertaining activity for people of various ages. However, trampolines have traditionally only been used by those people who are physically capable of maintaining some sense of balance throughout the activity. In more recent years, research has demonstrated that bouncing on trampolines, even minimally, can be useful in the development of balance, aerobic capacity, motor skills and muscle strength, and it can also strengthen your body's immune system, promote cellular repair, circulate more oxygen to the tissues, and promote various other health benefits. Because of these benefits, trampolines have been manufactured with some sort of support bar or support ring that enables people of more advanced age or with various disabilities to participate in the therapeutic benefits of trampolining. Unfortunately, the use of support rings, while adding a great stabilizing factor for those who need it, can also make it difficult to get on and off the trampoline.

SUMMARY

The present invention is directed to a trampoline assembly comprising a bed, a base frame, a plurality of first resilient members that connect the bed to the base frame, and a support assembly. In certain embodiments, the support assembly includes (i) a plurality of support arches connected to the base frame and cantilevering upward away from the base frame; (ii) a first support segment that is connected to the base frame and one of the support arches; (iii) a second support segment that is connected to the base frame and one of the support arches; (iv) a support bar; and (v) a plurality of support resilient members that connect the support bar to at least one of the plurality of support arches.

In some of these embodiments, the plurality of support arches extend around only a portion of the base frame. Further, in these embodiments, each support arch can be connected to at least one of the other support arches. Additionally, in some of these embodiments, the support bar has a first end and a spaced apart second end. For example, in some embodiments the support bar is substantially C-shaped.

With this design, the trampoline assembly includes the support bar for supporting a person to allow people of a more advanced age or with various disabilities to participate in the therapeutic benefits of trampolining. Further, the trampoline assembly allows for easy access so that a person can get on and off of the trampoline relatively easily.

In some embodiments the support bar is substantially horizontal. In one such embodiment, the plurality of support resilient members connect the support bar to one of the support arches, the first support segment and the second support segment. Further, in these embodiments, a top end of the first support segment and a top end of the second support segment are at approximately the same height as the support bar. In another such embodiment, the plurality of support resilient members connect the support bar to two of the support arches.

Additionally, the present invention is also directed to a method for making a trampoline assembly.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 3 is a simplified perspective view of a third embodiment of a trampoline assembly having features of the present invention.

DESCRIPTION

Figure 1:
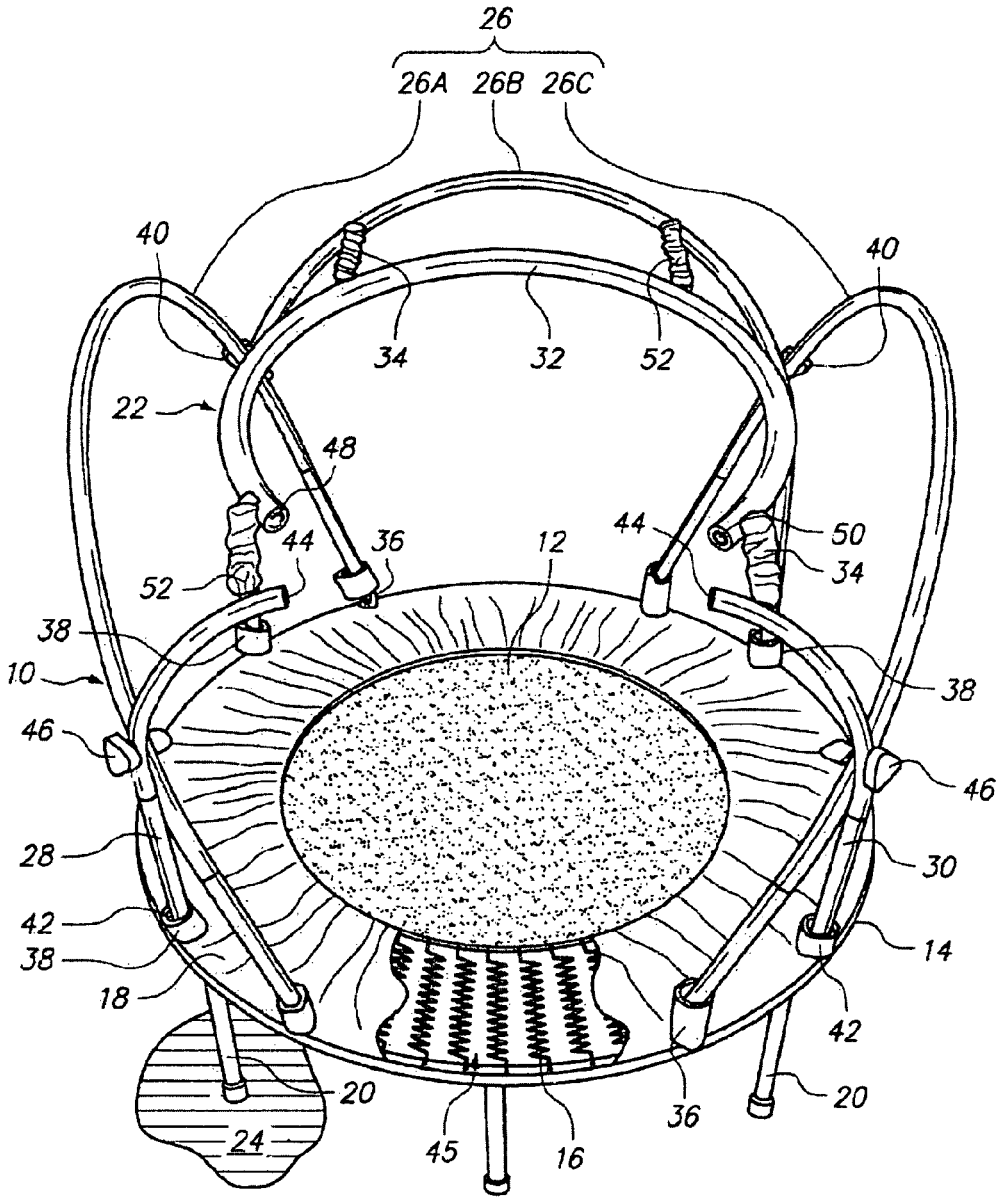
FIG. 1 is a simplified perspective view of a first embodiment of a trampoline assembly having features of the present invention.

FIG. 1 is a simplified perspective view of a first embodiment of a trampoline assembly 10 having features of the present invention. In this embodiment, the trampoline assembly 10 includes a bed 12, a base frame 14, a plurality of first resilient members 16 (some of which are illustrated in FIG. 1), a cover 18, a plurality of legs 20, and a support assembly 22. The plurality of first resilient members 16 connect the bed 12 to the base frame 14, so as to place the bed 12 in tension.

As an overview, the support assembly 22 is uniquely designed to provide support to a person to allow people of a more advanced age or with various disabilities to participate in the therapeutic benefits of trampolining. Further, the support assembly 22 is designed to allow for easy access so that a person can get on and off of the trampoline relatively easily.

The design of the bed 12 can be varied depending upon the requirements of the trampoline assembly 10 and/or the base frame 14. In the embodiment illustrated in FIG. 1, the bed is substantially circular in shape. Alternatively, the bed 12 can be substantially oval shaped, square shaped, rectangle shaped, or some other shape. In one embodiment, the bed 12 is approximately thirty-one inches in diameter. Alternatively, the bed 12 can be greater than four feet or less than four feet in diameter.

The design of the base frame 14 can be varied depending on the requirements of the trampoline assembly 10, the bed 12 and/or the plurality of first resilient members 16. In the embodiment illustrated in FIG. 1, the base frame 14 is substantially circular in shape. Alternatively, the base frame 14 can be substantially oval shaped, square shaped, rectangle shaped, or some other shape. In one embodiment, the base frame 14 is a tubular frame that is approximately four feet in diameter. Alternatively, the base frame 14 can be greater than five feet or less than five feet in diameter.

The base frame 14 can include a plurality of sections that can be secured together to form the base frame 14. In one embodiment, the base frame 14 is formed from a pair of sections that are each substantially semi-circular in shape. With this modular-type design, shipping and disassembly for storage of the base frame 14 is facilitated. Alternatively, the base frame 14 can be formed as a unitary structure. Further, the base frame 14 can be formed from various materials such as metal, wood, plastic, composite materials, ceramic, or any other suitably rigid materials. Alternatively, a combination of any of such materials can be used.

The plurality of first resilient members 16 connect the bed 12 to the base frame 14, so as to maintain the bed 12 in tension. Each first resilient member 16 can include a spring, elastic, plastic, rubber, or other suitably resilient structure. The size and number of the first resilient members 16 can vary. For example, in one embodiment, the trampoline assembly can include approximately 48 similarly-sized extension springs equally spaced around the perimeter of the bed 12. Each spring can have a one-inch diameter and be formed from 12-gauge steel. However, the trampoline assembly 10 can be designed to have greater than 48 or fewer than 48 springs that have various dimensions and are made of various materials.

The cover 18 substantially covers at least a portion of the plurality of first resilient members 16 (a portion of the cover 18 is cut away in FIG. 1 to illustrate some of the plurality of resilient members 16). The cover 18 is designed to help protect the user from injury by preventing the user from getting hands or feet or other body parts caught or pinched within the plurality of first resilient members 16. The cover 18 can be made of nylon or other suitable, pliable material. In certain embodiments, a layer of padding (not illustrated in FIG. 1) can be positioned between the cover 18 and the plurality of first resilient members 16.

In the embodiment illustrated in FIG. 1, the legs 20 are connected to the base frame 14 and are spaced apart around the base frame 14, so as to maintain the base frame 14 and the bed 12 above a support surface 24, such as a floor or the ground. The configuration and the number of legs 20 can vary. For example, in one embodiment, the trampoline assembly has eight substantially straight legs 20 that are equally spaced around the base frame 14. Alternatively, the trampoline assembly 10 can be designed to have more than eight or less than eight legs 20, and the legs 20 can have other than a straight leg design.

The support assembly 22 is designed to help support the user and to help the user to maintain balance while he or she uses the trampoline assembly 10. Additionally, the support assembly 22 is designed to enable the user to easily get on and off the trampoline assembly 10 before and after each use. In the embodiment illustrated in FIG. 1, the support assembly includes a plurality of support arches 26, a first support segment 28, a second support segment 30, a support bar 32, and a plurality of support resilient members 34.

The plurality of support arches 26, as illustrated in FIG. 1, are connected to the base frame 14 and cantilever upward away from the base frame 14. Further, the plurality of support arches 26 can be formed from various materials such as metal, wood, plastic, composite materials, ceramic, or any other suitably rigid materials. Alternatively, a combination of any of such materials can be used.

Each support arch 26 has a pair of spaced apart support arch ends 36 that are secured to the base frame 14 with a pair of base connectors 38. Alternatively, the support arch ends 36 can extend somewhat below the level of the base frame 14, with areas of the support arch 26 close to the support arch ends 36 being directly connected to the base frame 14. The base connectors 38 can include some sort of bracket connector, fastener, or some other type of connector that enables the support arch 26 to be securely attached to the base frame 14.

Each support arch 26 is further connected to at least one of the other support arches 26 with one or more arch connectors 40, so as create a much sturdier structure for the support assembly 22 to better support the user when using the trampoline assembly 10. The arch connectors 40 can include some sort of bracket connector, fastener or some other type of connector that enables each support arch 26 to be securely attached to one or more of the other support arches 26. In the embodiment illustrated in FIG. 1, the support assembly includes three support arches 26 that extend around only a portion of the base frame 14. Each support arch 26 overlaps somewhat and is connected to the adjacent support arch(es) 26 with one of the arch connectors 40. In other words, a first support arch 26A overlaps with and is connected to a second support arch 26B with an arch connector 40, and the second support arch 26B overlaps with and is connected to a third support arch 26C with an arch connector 40. Alternatively, the support assembly 22 can be designed to have more than three or less than three support arches 26.

The height of the arch connectors 40 and the degree of overlap of the adjacent support arches 26 can be varied depending upon the requirements of the support assembly 22. In the embodiment illustrated in FIG. 1, the arch connectors 40 are positioned at a point that is approximately one-third to one-half of the way up the overall height of the support arch 26. Further, the adjacent support arches 26 are shown to overlap by approximately 20 degrees around the circumference of the base frame 14. Alternatively, the arch connectors 40 can be positioned so that they are higher or lower than shown in FIG. 1, and the adjacent support arches 26 can overlap by more than 20 degrees or less than 20 degrees.

In one embodiment, the support arches 26 are at an angle of approximately 75 degrees relative to bed frame 14. Alternatively, the support arches 26 can be at an angle of greater than or lesser than 75 degrees relative to the bed frame 14.

In certain embodiments, the support arches 26 are collapsible. More specifically, the support arches 26 are selectively pivotable (e.g. hinge) relative to the bed frame 14 when the arch connectors 40 are detached so that the trampoline assembly 10 can be stored in a relatively small configuration. Alternatively, the trampoline assembly 10 can be designed so that the support arches 26 are not collapsible.

As noted above, the plurality of support arches 26 extend around only a portion of the base frame 14. With this design there is an open space 45 between the first support arch 26A and the third support arch 26C that enables the user to easily get on and off of the trampoline assembly 10, while still maintaining a significant strength and structural integrity to the support assembly 22.

The first support segment 28 is connected to the base frame 14 and the first support arch 26A, and the first support segment 28 cantilevers upward away from the base frame 14. The first support segment 28 includes a bottom end 42 and a top end 44. As shown in FIG. 1, the bottom end 42 of the first support segment 28 is connected to the base frame 14 with a base connector 38. Alternatively, the bottom end 42 can extend somewhat below the level of the base frame 14, with areas of the first support segment 28 close to the bottom end 42 being directly connected to the base frame 14. The base connector 38 can include some sort of bracket connector, fastener, or some other type of connector that enables the first support segment 28 to be securely attached to the base frame 14.

Additionally, the first support segment 28 is connected to the first support arch 26A with a segment connector 46. The segment connector 46 can include some sort of bracket connector, fastener, or some other type of connector that enables the first support segment 28 to be securely attached to the first support arch 26A. In this embodiment, the segment connector 46 is positioned approximately halfway between the bottom end 42 and the top end 44 of the first support segment 28.

The second support segment 30 is connected to the base frame 14 and the third support arch 26C, and the second support segment 30 cantilevers upward away from the base frame 14. The second support segment 30 includes a bottom end 42 and a top end 44. As shown in FIG. 1, the bottom end 42 of the second support segment 30 is connected to the base frame 14 with a base connector 38. Alternatively, the bottom end 42 can extend somewhat below the level of the base frame 14, with areas of the second support segment 30 close to the bottom end 42 being directly connected to the base frame 14. The base connector 38 can include some sort of bracket connector, fastener, or some other type of connector that enables the second support segment 30 to be securely attached to the base frame 14.

Additionally, the second support segment 30 is connected to the third support arch 26C with a segment connector 46. The segment connector 46 can include some sort of bracket connector, fastener or some other type of connector that enables the second support segment 30 to be securely attached to the third support arch 26C. In this embodiment, the segment connector 46 is positioned approximately halfway between the bottom end 42 and the top end 44 of the second support segment 28.

In FIG. 1, the top end 44 of the first support segment 28 curves somewhat toward the top end 44 of the second support segment 30, and the top end 44 of the second support segment 30 curves somewhat toward the top end 44 of the first support segment 28. In this embodiment, the top end 44 of the first support segment 28 and the top end 44 of the second support segment 30 are at a height that is equal to or approximately equal to the height of the support bar 32. For example, in non-exclusive embodiments, the height of the support segments 30 is within approximately 0.5, 1, 2, 3, or 5 inches of that of the support bar 32. In one embodiment, the first support segment 28 and the second support segment 30 are just portions of an incomplete arch that is similar in size and shape to the other arches 26.

It should be noted the words first, second and third are used to identify certain structural features of the present invention. However, the use of the terms first, second and third is merely for purposes of convenience and for identifying relative positioning of similar features. The terms first, second and third can easily be interchanged for identifying such similar features.

The support bar 32 is positioned above the bed 12 of the trampoline assembly 10 to provide the user with a stabilizer to enhance balance and coordination when using the trampoline assembly 10. As shown, the support bar 32 is positioned substantially horizontally (and substantially parallel with the bed 12) approximately three feet above the bed 12 of the trampoline assembly 10. Alternatively, the support bar 32 can be positioned so that it is greater than three feet or less than three feet above the bed 12 of the trampoline assembly 10.

In the embodiment illustrated in FIG. 1, the support bar 32 has a semi-enclosed shape having a first end 48 and a spaced apart second end 50. With this design the user can easily get on and off the trampoline assembly 10 and gain access to the support bar 32 within the semi-enclosed figure. In one embodiment, the support bar 32 can be substantially C-shaped. Alternatively, the support bar 32 can be substantially U-shaped, substantially rectangle-shaped with one side or most of one side open or missing, substantially square-shaped with one side or most of one side open or missing, or some other shape.

The plurality of support resilient members 34 connect the support bar 32 to the rest of the support assembly 22. Each support resilient member 34 can include a spring, elastic, plastic, rubber, or other suitably resilient structure. Further, each support resilient member 34 can include a support cover 52 that is designed to help protect the user from injury by preventing the user from getting hands or feet or other body parts caught or pinched within the support resilient member 34. The support cover 52 can be made of nylon or other suitable, pliable material.

In the embodiment illustrated in FIG. 1, the support assembly 22 includes four support resilient members 34, wherein one support resilient member 34 is positioned near the first end 48 of the support bar 32, one support resilient member 34 is positioned near the second end 50 of the support bar 32, and two support resilient members 34 are substantially evenly spaced along the support bar 32 between the first end 48 and the second end 50. As shown, two support resilient members 34 connect the support bar 32 to the second support arch 26B, one support resilient member 34 connects the support bar 32 to the first support segment 28 near the top end 44 of the first support segment 28, and one support resilient member 34 connects the support bar 32 to the second support segment 30 near the top end 44 of the second support segment 30. Alternatively, the support assembly 22 can be designed to include more than four support resilient members 34 or less than four support resilient members 34, one or more of the support resilient members 34 can be connected to the first support arch 26A or the second support arch 26C, and/or the spacing between the support resilient members 34 can be varied.

Figure 2:
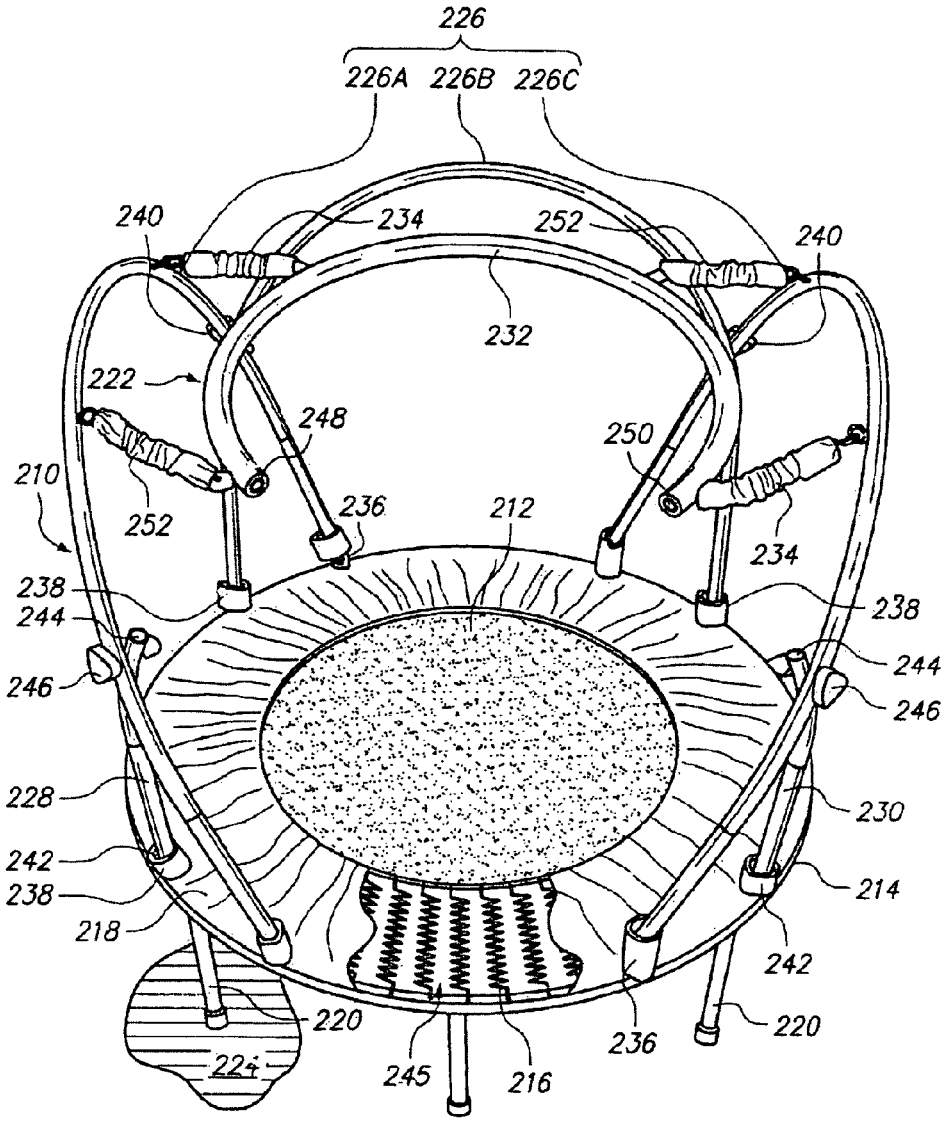
FIG. 2 is a simplified perspective view of a second embodiment of a trampoline assembly having features of the present invention.

FIG. 2 is a simplified perspective view of a second embodiment of a trampoline assembly 210 having features of the present invention. In this embodiment, the trampoline assembly 210 includes a bed 212, a base frame 214, a plurality of first resilient members 216 (some of which are illustrated in FIG. 2), a cover 218, a plurality of legs 220, and a support assembly 222. The plurality of first resilient members 216 connect the bed 212 to the base frame 214, so as to place the bed 212 in tension. In this embodiment, the bed 212, the base frame 214, the plurality of resilient members 216, the cover 218, and the plurality of legs 220, are substantially similar to the bed 12, the base frame 214, the plurality of resilient members 16, the cover 18, and the plurality of legs 20 in the embodiment described above in connection with FIG. 1. Therefore, the bed 212, the base frame 214, the plurality of resilient members 216, the cover 218, and the plurality of legs 220 in this embodiment will not be described in greater detail herein.

The support assembly 222 is designed to help support the user and to help the user to maintain balance while he or she uses the trampoline assembly 210. Additionally, the support assembly 222 is designed to enable the user to easily get on and off the trampoline assembly 210, i.e. to move between the support surface 224 and the bed 212, before and after each use. In the embodiment illustrated in FIG. 2, the support assembly includes a plurality of support arches 226, a first support segment 228, a second support segment 230, a support bar 232, and a plurality of support resilient members 234.

The plurality of support arches 226, as illustrated in FIG. 2, are connected to the base frame 214 and cantilever upward away from the base frame 214. Further, the plurality of support arches 226 can be formed from various materials such as metal, wood, plastic, composite materials, ceramic, or any other suitably rigid materials. Alternatively, a combination of any of such materials can be used.

Each support arch 226 has a pair of spaced apart support arch ends 236 that are secured to the base frame 214 with a pair of base connectors 238. Alternatively, the support arch ends 236 can extend somewhat below the level of the base frame 214, with areas of the support arch 226 close to the support arch ends 236 being directly connected to the base frame 214. The base connectors 238 can include some sort of bracket connector, fastener, or some other type of connector that enables the support arch 226 to be securely attached to the base frame 214.

Each support arch 226 is further connected to at least one of the other support arches 226 with one or more arch connectors 240, so as create a much sturdier structure for the support assembly 222 to better support the user when using the trampoline assembly 210. The arch connectors 240 can include some sort of bracket connector, fastener, or some other type of connector that enables each support arch 226 to be securely attached to one or more of the other support arches 226. In the embodiment illustrated in FIG. 2, the support assembly includes three support arches 226 that extend around only a portion of the base frame 214. Each support arch 226 overlaps somewhat and is connected to the adjacent support arch(es) 226 with one of the arch connectors 240. In other words, a first support arch 226A overlaps with and is connected to a second support arch 226B with an arch connector 240, and the second support arch 226B overlaps with and is connected to a third support arch 226C with an arch connector 240. Alternatively, the support assembly 222 can be designed to have more than three or less than three support arches 226.

The height of the arch connectors 240 and the degree of overlap of the adjacent support arches 226 can be varied depending upon the requirements of the support assembly 222. In the embodiment illustrated in FIG. 2, the arch connectors 240 are positioned at a point that is approximately one-third to one-half of the way up the overall height of the support arch 226. Further, the adjacent support arches 226 are shown to overlap by approximately 20 degrees around the circumference of the base frame 214. Alternatively, the arch connectors 240 can be positioned so that they are higher or lower than shown in FIG. 2, and the adjacent support arches 226 can overlap by more than 20 degrees or less than 20 degrees.

In one embodiment, the support arches 226 are at an angle of approximately 75 degrees relative to bed frame 214. Alternatively, the support arches 226 can be at an angle of greater than or lesser than 75 degrees relative to the bed frame 214.

In certain embodiments, the support arches 226 are collapsible. More specifically, the support arches 226 are selectively pivotable relative to the bed frame 214 so that the trampoline assembly 210 can be stored in a relatively small configuration.

As noted above, the plurality of support arches 226 extend around only a portion of the base frame 214. With this design there is an open space 245 between the first support arch 226A and the third support arch 226C that enables the user to easily get on and off of the trampoline assembly 210, while still maintaining a significant strength and structural integrity to the support assembly 222.

The first support segment 228 is connected to the base frame 214 and the first support arch 226A, and the first support segment 228 cantilevers upward away from the base frame 214. The first support segment 228 includes a bottom end 242 and a top end 244. As shown in FIG. 2, the bottom end 242 of the first support segment 228 is connected to the base frame 214 with a base connector 238. Alternatively, the bottom end 242 can extend somewhat below the level of the base frame 214, with areas of the first support segment 228 close to the bottom end 242 being directly connected to the base frame 214. The base connector 238 can include some sort of bracket connector, fastener, or some other type of connector that enables the first support segment 228 to be securely attached to the base frame 214.

Additionally, the first support segment 228 is connected to the first support arch 226A with a segment connector 246. The segment connector 246 can include some sort of bracket connector or some other type of connector that enables the first support segment 228 to be securely attached to the first support arch 226A. In this embodiment, the segment connector 246 is positioned near the top end 244 of the first support segment 228.

The second support segment 230 is connected to the base frame 214 and the third support arch 226C, and the second support segment 230 cantilevers upward away from the base frame 214. The second support segment 230 includes a bottom end 242 and a top end 244. As shown in FIG. 2, the bottom end 242 of the second support segment 230 is connected to the base frame 214 with a base connector 238. Alternatively, the bottom end 242 can extend somewhat below the level of the base frame 214, with areas of the second support segment 230 close to the bottom end 242 being directly connected to the base frame 214. The base connector 238 can include some sort of bracket connector or some other type of connector that enables the second support segment 230 to be securely attached to the base frame 214.

Additionally, the second support segment 230 is connected to the third support arch 226C with a segment connector 246. The segment connector 246 can include some sort of bracket connector or some other type of connector that enables the second support segment 230 to be securely attached to the third support arch 226C. In this embodiment, the segment connector 246 is positioned near the top end 244 of the second support segment 228.

The support bar 232 is positioned above the bed 212 of the trampoline assembly 210 to provide the user with a stabilizer to enhance balance and coordination when using the trampoline assembly 210. As shown, the support bar 232 is positioned substantially horizontally approximately three feet above the bed 212 of the trampoline assembly 210. Alternatively, the support bar 232 can be positioned so that it is greater than three feet or less than three feet above the bed 212 of the trampoline assembly 210.

In the embodiment illustrated in FIG. 2, the support bar 232 has a semi-enclosed shape having a first end 248 and a spaced apart second end 250. With this design the user can easily get on and off the trampoline assembly 210 and gain access to the support bar 232 within the semi-enclosed figure. In one embodiment, the support bar 232 can be substantially C-shaped. Alternatively, the support bar 232 can be substantially U-shaped, substantially rectangle-shaped with one side or most of one side open or missing, substantially square-shaped with one side or most of one side open or missing, or some other shape.

The plurality of support resilient members 234 connect the support bar 232 to the rest of the support assembly 222. Each support resilient member 234 can include a spring, elastic, plastic, rubber, or other suitably resilient structure. Further, each support resilient member 234 can include a support cover 252 that is designed to help protect the user from injury by preventing the user from getting hands or feet or other body parts caught or pinched within the support resilient member 234. The support cover 252 can be made of nylon or other suitable, pliable material.

In the embodiment illustrated in FIG. 2, the support assembly 222 includes four support resilient members 234, wherein one support resilient member 234 is positioned near the first end 248, one support resilient member 234 is positioned near the second end 250, and two support resilient members 234 are substantially evenly spaced along the support bar 232 between the first end 248 and the second end 250. As shown, two support resilient members 234 connect the support bar 232 to the first support arch 226A, and two support resilient members 234 connect the support bar 232 to the third support arch 226C. Alternatively, the support assembly 222 can be designed to include more than four support resilient members 234 or less than four support resilient members 234, and/or the spacing between the support resilient members 234 can be varied.

FIG. 3 is a simplified perspective view of a third embodiment of a trampoline assembly 310 having features of the present invention. In this embodiment, the trampoline assembly 310 includes a bed 312, a base frame 314, a plurality of first resilient members 316 (some of which are illustrated in FIG. 3), a cover 318, a plurality of legs 320, and a support assembly 322 that are somewhat similar to the corresponding components described above and illustrated in FIG. 1. However, in this embodiment, the plurality of support arches 326 are slightly different. More specifically, in this embodiment, the support assembly 322 only includes a first support arch 326A and a third support arch 326C.

Further, in this embodiment, the support assembly 322 includes a first support segment 328 and a second support segment 330 that are similar to the corresponding components described above. However, in this embodiment, the support assembly 322 also includes a third support segment 328A and a fourth support segment 330A that are similar to the first support segment 328 and the second support segment 330. In this embodiment, the second support arch 26B (illustrated in FIG. 1) has been replaced with the third support segment 328A and the fourth support segment 330A.

With this design, the plurality of support arches 326 extend around only a portion of the base frame 314. With this design there is opposed open spaces 345 between the first support arch 326A and the third support arch 326C that enables the user to easily get on and off of the trampoline assembly 310, while still maintaining a significant strength and structural integrity to the support assembly 322.

While the particular trampoline assembly 10 as herein shown and disclosed in detail is fully capable of obtaining the objects and providing the advantages herein before stated, it is to be understood that it is merely illustrative of some of the presently preferred embodiments of the invention and that no limitations are intended to the details of construction or design herein shown other than as described in the appended claims.

What is claimed is:

1. A trampoline assembly comprising:

a bed;

a base frame;

a plurality of first resilient members that connect the bed to the base frame; and a support assembly including (i) a plurality of support arches connected to the base frame and cantilevering upward away from the base frame, the plurality of support arches extending around only a portion of the base frame; (ii) a first support segment that is connected to the base frame and one of the support arches; (iii) a second support segment that is connected to the base frame and one of the support arches; (iv) a support bar, wherein a top end of the first support segment and a top end of the second support segment are at approximately the same height as the support bar; and (v) a plurality of support resilient members that connect the support bar to at least one of the plurality of support arches.

2. The trampoline assembly of claim 1 wherein each support arch is connected to at least one of the other support arches.

3. The trampoline assembly of claim 1 wherein the support bar is substantially C-shaped.

4. The trampoline assembly of claim 1 wherein the support bar has a first end and a spaced apart second end.

5. The trampoline assembly of claim 1 wherein the support bar is substantially horizontal.

6. The trampoline assembly of claim 5 wherein the plurality of support resilient members further connect the support bar to the first support segment and the second support segment.

7. A trampoline assembly comprising:

a bed;

a base frame;

a plurality of first resilient members that connect the bed to the base frame; and a support assembly including (i) a plurality of support arches connected to the base frame and cantilevering upward away from the base frame; (ii) a first support segment that is connected to the base frame and one of the support arches; (iii) a second support segment that is connected to the base frame and one of the support arches; (iv) a support bar having a first end and a spaced apart second end, wherein a top end of the first support segment and a top end of the second support segment are at approximately the same height as the support bar; and (v) a plurality of support resilient members that connect the support bar to at least one of the plurality of support arches.

8. The trampoline assembly of claim 7 wherein each support arch is connected to at least one of the other support arches.

9. The trampoline assembly of claim 7 wherein the support bar is substantially C-shaped.

10. The trampoline assembly of claim 7 wherein the support bar is substantially horizontal.

11. The trampoline assembly of claim 10 wherein the plurality of support resilient members further connect the support bar to the first support segment and the second support segment.

12. A method for making a trampoline assembly that supports a user above a surface, the method comprising the steps of:

providing a bed;

providing a base frame;

connecting the bed to the base frame with a plurality of first resilient members;

connecting a plurality of support arches to the base frame with the support arches cantilevering upward away from the base frame, the plurality of support arches extending around only a portion of the base frame;

connecting a first support segment to the base frame and one of the support arches;

connecting a second support segment to the base frame and one of the support arches;

providing a support bar, wherein a top end of the first support segment and a top end of the second support segment are at approximately the same height as the support bar; and connecting the support bar to at least one of the plurality of support arches with a plurality of support resilient members.

13. The method of claim 12 wherein the step of providing a support bar includes the step of providing a support bar having a first end and a spaced apart second end.

14. The method of claim 12 wherein the step of connecting the support bar includes the step of connecting the support bar to the first support segment and the second support segment with the plurality of support resilient members.

15. A trampoline assembly comprising:

a bed;

a base frame;

a plurality of first resilient members that connect the bed to the base frame; and a support assembly including (i) a plurality of support arches connected to the base frame and cantilevering upward away from the base frame; (ii) a first support segment that is connected to the base frame and one of the support arches, the first support segment including a bottom end that is positioned near the base frame and a top end that cantilevers away from the base frame so that it is positioned above the base frame, the first support segment being connected to one of the support arches between the bottom end and the top end; (iii) a second support segment that is connected to the base frame and one of the support arches; (iv) a support bar; and (v) a plurality of support resilient members that connect the support bar to at least one of the plurality of support arches.

16. The trampoline assembly of claim 15 wherein the second support segment includes a bottom end that is positioned near the base frame and a top end that cantilevers away from the base frame so that it is positioned above the base frame, the second support segment being connected to one of the support arches between the bottom end and the top end.

17. The trampoline assembly of claim 15 wherein the first support segment is connected to one of the support arches approximately halfway between the bottom end and the top end.

18. The trampoline assembly of claim 15 wherein the support bar has a first end and a spaced apart second end.

19. The trampoline assembly of claim 15 wherein each support arch is connected to at least one of the other support arches, and wherein the plurality of support arches extends around only a portion of the base frame.

20. The trampoline assembly of claim 15 wherein the plurality of support resilient members further connect the support bar to the first support segment and the second support segment.

* * * * *